US011462205B2

(12) United States Patent
Tachi et al.

(10) Patent No.: US 11,462,205 B2
(45) Date of Patent: Oct. 4, 2022

(54) IN-VEHICLE COMMUNICATION SUPPORT SYSTEM

(71) Applicants: ALPS ALPINE CO., LTD., Tokyo (JP); A School Corporation Kansai University, Suita (JP)

(72) Inventors: Ryosuke Tachi, Iwaki (JP); Yoshinobu Kajikawa, Suita (JP)

(73) Assignees: ALPS ALPINE CO., LTD, Tokyo (JP); A SCHOOL CORPORATION KANSAI UNIVERSITY, Osaka (JP)

( * ) Notice: Subject to any disclaimer, the term of this patent is extended or adjusted under 35 U.S.C. 154(b) by 0 days.

(21) Appl. No.: 17/361,979

(22) Filed: Jun. 29, 2021

(65) Prior Publication Data

US 2022/0005452 A1 Jan. 6, 2022

(30) Foreign Application Priority Data

Jul. 3, 2020 (JP) ..... JP2020-115623

(51) Int. Cl.
*G10K 11/178* (2006.01)
*H04R 3/00* (2006.01)

(52) U.S. Cl.
CPC ..... *G10K 11/17854* (2018.01); *H04R 3/00* (2013.01); *G10K 2210/1282* (2013.01); *G10K 2210/3028* (2013.01); *H04R 2499/13* (2013.01)

(58) Field of Classification Search
CPC ..... G10K 11/17854; G10K 2210/1282; G10K 2210/108
See application file for complete search history.

(56) References Cited

U.S. PATENT DOCUMENTS

2015/0243271 A1* 8/2015 Goldstein ..... G10K 11/17854 381/71.6
2020/0020315 A1 1/2020 Tachi et al.

FOREIGN PATENT DOCUMENTS

| | | |
|---|---|---|
| JP | 2002-051392 | 2/2002 |
| JP | 2002-51392 A | 2/2002 |
| JP | 2010-163054 | 7/2010 |
| JP | 2018-072770 | 5/2018 |
| JP | 2020-012917 | 1/2020 |

OTHER PUBLICATIONS

English machine translation of JP 2010-163054, 16 pages. (Year: 2010).*
European Search Report dated Nov. 26, 2021 in corresponding European Application No. 21181431.4, 27 pages.

* cited by examiner

*Primary Examiner* — Ping Lee
(74) *Attorney, Agent, or Firm* — Crowell & Moring LLP

(57) ABSTRACT

A first variable filter receives a sound of a second seat audio source as an input and generates a cancel sound for canceling the sound of the second seat audio source at a first seat. The transfer functions of the first variable filter and the second variable filter are updated such that the level of a signal obtained by subtracting the output of the auxiliary filter that generates a correction signal for correcting the difference between the positions of the first seat microphone and the first seat and the output of the second variable filter that receives the sound of the first seat audio source from the output of the first seat microphone is minimized. While the level of the signal exceeds a threshold, the signal is relayed to the second seat as a spoken voice.

5 Claims, 5 Drawing Sheets

IN-VEHICLE COMMUNICATION SUPPORT SYSTEM

RELATED APPLICATION

The present application claims priority to Japanese Patent Application Number 2020-115623, filed Jul. 3, 2020, the entirety of which is hereby incorporated by reference.

BACKGROUND

1. Field of the Invention

The present invention relates to a technology for supporting communication by voice in a vehicle.

2. Description of the Related Art

As a technique for supporting communication based on voice in a vehicle, a technique is known in which a spoken voice of a user seated on a first seat of an automobile is collected by a microphone for the first seat and is output from a speaker for a second seat of the automobile (for example, JP 2002-51392A).

Further, in such a technique, there is also known a technique of canceling a sound such as music output from a speaker for the first seat from a sound collected by a microphone for the first seat and then outputting the sound from a speaker for the second seat (for example, JP 2010-163054A).

Further, a technique related to the present disclosure is an active noise control (ANC) technology including: a microphone disposed near a noise cancel position; an adaptive filter configured to generate a cancel sound for canceling noise at the noise cancel position from an output signal of a noise source; and a speaker configured to output the cancel sound, in which in the adaptive filter, a transfer function is adaptively set using a signal obtained by correcting an output of the microphone using an auxiliary filter as an error signal (for example, JP 2020-12917A and JP 2018-72770A).

In this technology, a transfer function that corrects a signal actually output by the microphone is set in a signal output from the microphone when the microphone is arranged at the noise cancel position learned in advance in the auxiliary filter, and the noise is canceled at the noise cancel position different from the position of the microphone by using such an auxiliary filter.

In a case where the sound of a first sound source is output from the speaker for a first seat and the sound of a second sound source is output from the speaker for a second seat in order for the user of the first seat and the user of the second seat to enjoy mutually different music or the like, it is not possible to clearly output the spoken voice of the user of the first seat from the speaker for the second seat to the user of the second seat with a good SN ratio only by canceling the sound of the first sound source from the sound collected by the microphone for the first seat under an environment in which the sounds of both sound sources are propagated to the microphone for the first seat.

Further, in a case where the user at the first seat and the user at the second seat are listening to sounds of different sound sources, it is desirable that each user cannot hear a sound of a sound source being listened to by another user.

SUMMARY

Therefore, an object of the present disclosure is to provide an in-vehicle communication support system capable of performing good communication by voice between users while suppressing the user from hearing the sound of the sound source listened to by another user in an environment where the users at the respective seats of the automobile are listening to the sounds of different sound sources.

In order to achieve the above object, the present disclosure provides an in-vehicle communication support system mounted in an automobile having a first seat and a second seat that are different seats from each other, including: a microphone configured to collect sound of the first seat; a first sound source device; a first speaker that is a speaker for a user at the first seat and outputs an output sound of the first sound source device; a second sound source device; a second speaker that is a speaker for a user at a second seat and outputs an output sound of the second sound source device; a noise control unit configured to output, from the first speaker, a cancel sound for canceling the output sound of the second sound source device output from the second speaker to the user at the first seat; and a spoken voice output unit. The noise control unit includes: a first adaptive filter that receives an output sound of the second sound source device as an input and generates the cancel sound; a second adaptive filter that receives an output sound of the first sound source device as an input; and a first signal generation unit that generates a first signal which is a signal obtained by subtracting at least an output of the second adaptive filter from an output of the microphone, and the first adaptive filter and the second adaptive filter perform an adaptive operation of updating its own transfer function such that a level of the first signal decreases. The spoken voice output unit outputs the first signal from the second speaker as a spoken voice of the user at the first seat.

Here, in such an in-vehicle communication support system, the noise control unit may include an auxiliary filter that receives an output sound of the second sound source device, and the first signal generation unit may generate, as the first signal, a signal obtained by subtracting the output of the second adaptive filter and an output of the auxiliary filter from the output of the microphone. However, a transfer function obtained in advance as a transfer function for correcting the output of the microphone to a sound collected at a listening position of the sound of the user at the first seat by subtracting the output of the auxiliary filter from the output of the microphone is set to the auxiliary filter.

Further, in the above-described in-vehicle communication support system, the spoken voice output unit may be configured to output the first signal from the second speaker when the first signal is greater than a predetermined level.

Further, in this case, in the spoken voice output unit, the spoken voice output unit may stop the adaptive operations of the first adaptive filter and the second adaptive filter when the first signal is larger than a predetermined level.

According to the in-vehicle communication support system as described above, it is possible to output the spoken voice of the user at the first seat from the second speaker with a good SN ratio to the user at the second seat while suppressing the user at the first seat from hearing the sound of the second sound source device listened to by the user at the second seat, and to support the user at the second seat listening to the spoken voice of the user at the first seat.

As described above, according to the present disclosure, it is possible to provide an in-vehicle communication support system capable of performing good communication by voice between users while suppressing the user from hearing the sound of the sound source listened to by another user in an environment where the users at the respective seats of the automobile are listening to the sounds of different sound sources.

DETAILED DESCRIPTION OF THE PREFERRED EMBODIMENTS

In the following, an embodiment of the invention will be described.

Figure 1:
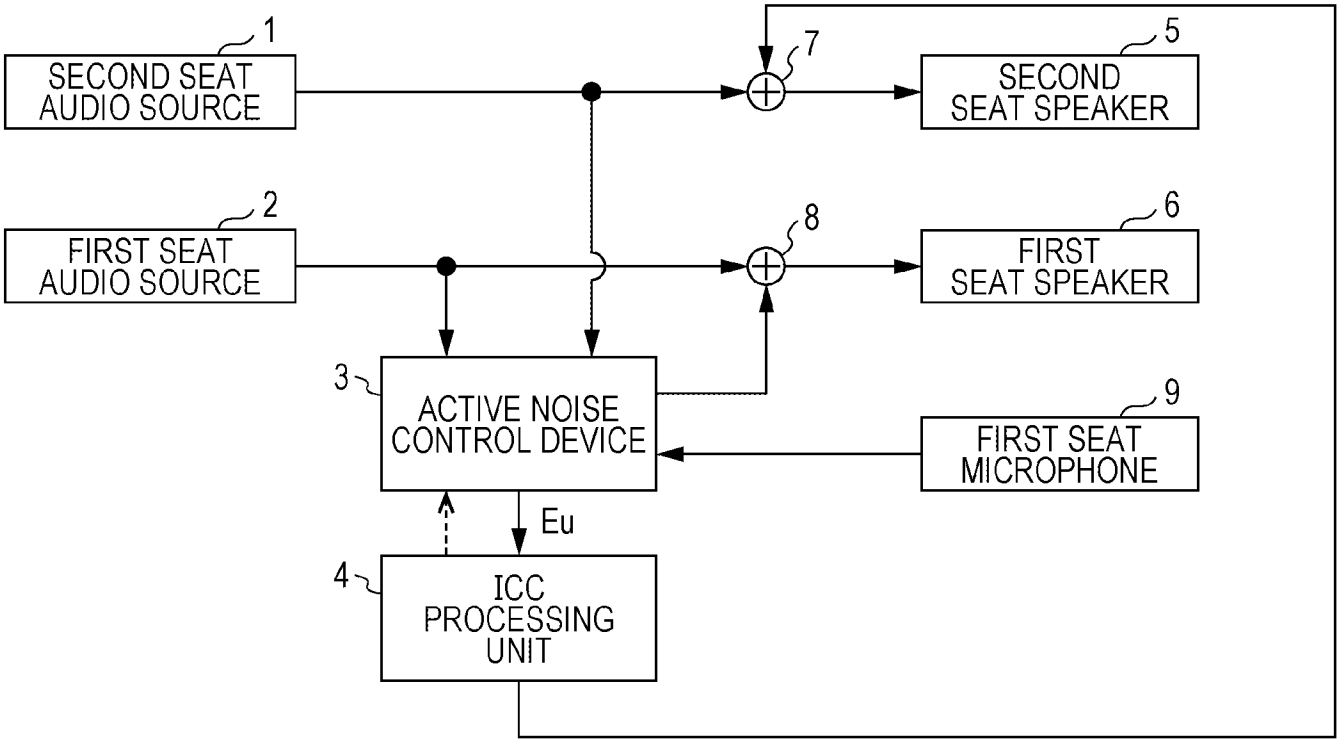
FIG. 1 is a block diagram illustrating a configuration of an in-vehicle communication support system according to an embodiment of the invention.

FIG. 1 illustrates a configuration of an in-vehicle communication support system according to this embodiment.

The in-vehicle communication support system is a system mounted in an automobile, and includes a second seat audio source 1, a first seat audio source 2, an active noise control device 3, an ICC processing unit 4 (In-Car Communication processing unit 4), a second seat speaker 5, a first seat speaker 6, a second seat speaker adder 7, a first seat speaker adder 8, and a first seat microphone 9, as illustrated in the drawing.

Figure 2:
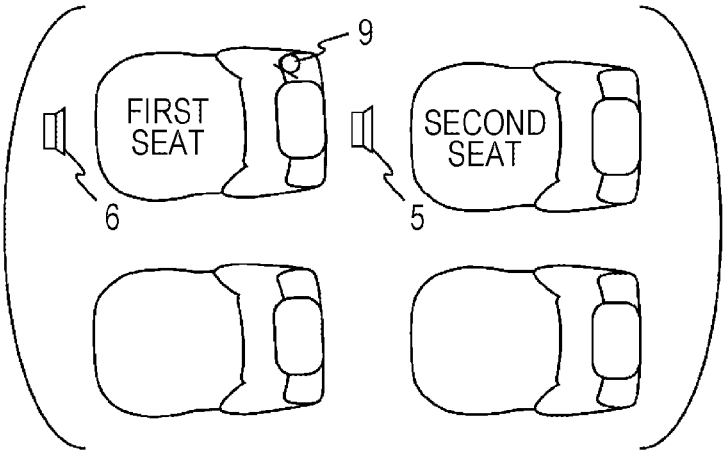
FIG. 2 is a diagram illustrating an arrangement of a speaker and a first seat microphone of the in-vehicle communication support system according to the embodiment of the invention.

As illustrated in FIG. 2, assuming that one seat of the automobile is a first seat and another seat other than the first seat is a second seat, the first seat speaker 6 is a speaker disposed near the first seat for a user at the first seat, and the second seat speaker 5 is a speaker disposed near the second seat for a user at the second seat. The arrangement of the first seat speaker 6 and second seat speaker 5 in FIG. 2 is merely an example. Any arrangement and number of the first seat speaker 6 and the second seat speaker 5 may be used as long as the first seat speaker 6 mainly radiates sound to the user at the first seat and the second seat speaker 5 mainly radiates sound to the user at the second seat.

The first seat microphone 9 is, for example, a microphone disposed near the first seat as illustrated in FIG. 2. Returning to FIG. 1, the first seat audio source 2 is a sound source that outputs a sound of music or the like listened to by the user at the first seat, and the sound output from the first seat audio source 2 is output from the first seat speaker 6 via the first seat speaker adder 8.

The second seat audio source 1 is a sound source that outputs a sound of music or the like listened to by the user at the second seat, and the sound output from the second seat audio source 1 is output from second seat speaker 5 via the second seat speaker adder 7.

The sound from the second seat audio source 1, the sound from the first seat audio source 2, and the sound collected by the first seat microphone 9 are input to the active noise control device 3, and the active noise control device 3 generates, from these input sounds, a cancel sound for canceling sound from the second seat audio source 1 audible to the user at the first seat at the position of the user at the first seat, and outputs the cancel sound from the first seat speaker 6 via the first seat speaker adder 8.

In addition, the active noise control device 3 extracts a spoken voice Eu of the user at the first seat included in the sound collected by the first seat microphone 9 using the input sound, and outputs the spoken voice Eu to the ICC processing unit 4. Then, the ICC processing unit 4 outputs, from the second seat speaker 5 via the second seat speaker adder 7, the spoken voice Eu input from the active noise control device 3 or a voice obtained by subjecting the spoken voice Eu to predetermined acoustic processing, thereby supporting the listening of the spoken voice of the first seat user by the second seat user.

Figure 3:
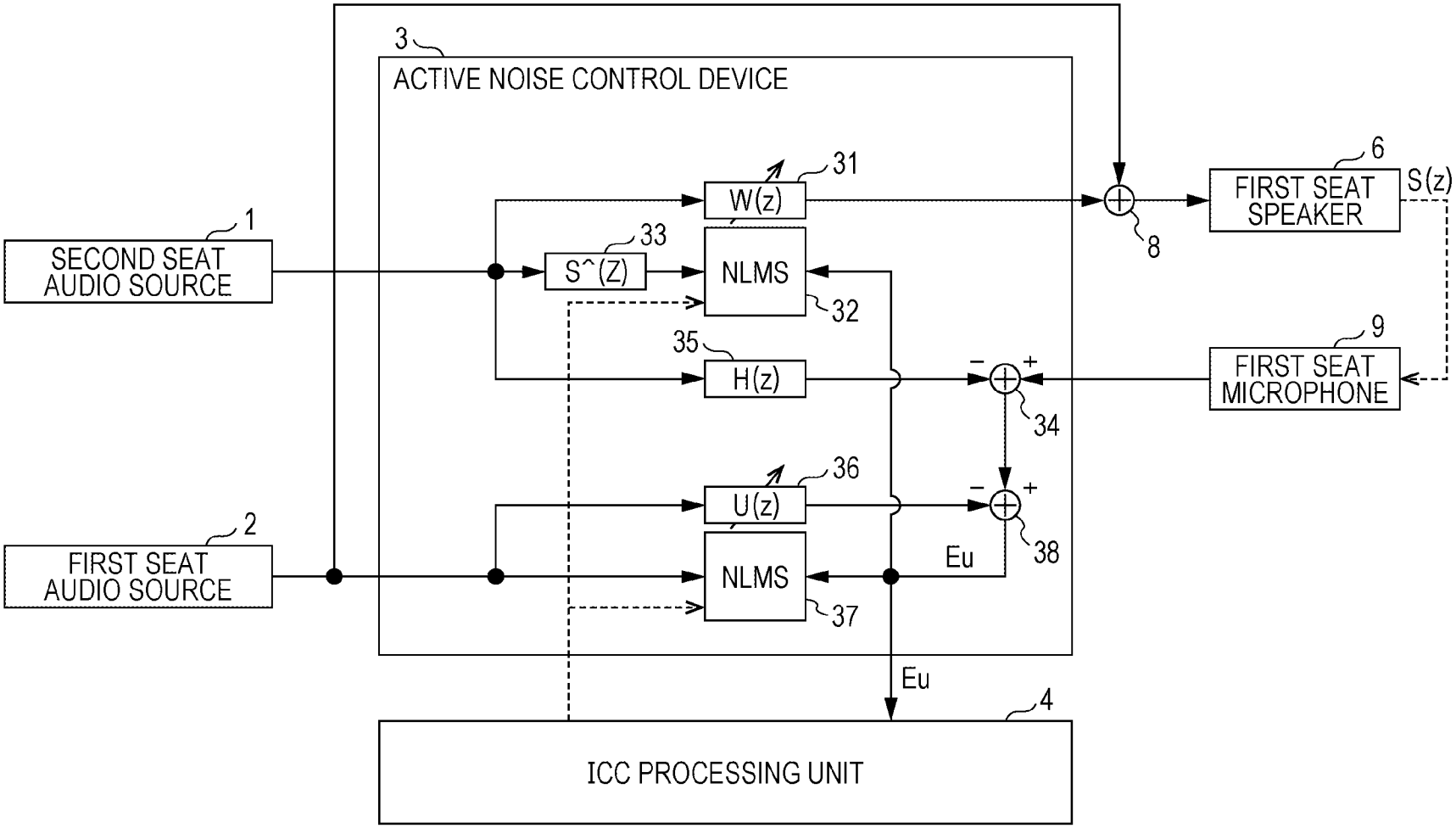
FIG. 3 is a block diagram illustrating a configuration of an active noise control device according to the embodiment of the invention.

Next, FIG. 3 illustrates a configuration of the active noise control device 3. As shown in the drawing, the active noise control device 3 includes a first variable filter 31, a first adaptive algorithm execution unit 32, an estimation filter 33 in which a transfer function $\hat{S}(z)$ is set in advance, a first subtractor 34, an auxiliary filter 35 in which a transfer function H(z) is set in advance, a second variable filter 36, a second adaptive algorithm execution unit 37, and a second subtractor 38.

The sound input from the second seat audio source 1 passes through the first variable filter 31 and is output as a cancel sound from the first seat speaker 6 via the first seat speaker adder 8. The sound input from the second seat audio source 1 is transmitted to the first subtractor 34 through the auxiliary filter 35. The first subtractor 34 subtracts the output of the auxiliary filter 35 from the sound collected by the first seat microphone 9, and transmits the subtracted sound to the second subtractor 38. The transfer function H(z) for correcting a signal actually output by the first seat microphone 9 is preset in the auxiliary filter 35 so that the output of the first subtractor 34 becomes a signal output from the first seat microphone 9 when the first seat microphone 9 is located at the position of the ear of the user at the first seat. A method of setting the transfer function H(z) of the auxiliary filter 35 will be described later.

Meanwhile, the sound input from the first seat audio source 2 is transmitted to the second subtractor 38 through the second variable filter 36. The second subtractor 38 outputs a signal Eu obtained by subtracting the output of the second variable filter 36 from the output of the first subtractor 34 to the first adaptive algorithm execution unit 32 and the second adaptive algorithm execution unit 37, and outputs the signal Eu to the ICC processing unit 4 as the spoken voice Eu.

An estimated transfer characteristic $\hat{Sv}(z)$ obtained by estimating the transfer function S(z) from the active noise control device 3 to the first seat microphone 9 by actual measurement or the like is preset in the estimation filter 33, and the estimation filter 33 convolves the transfer characteristic $\hat{S}(z)$ with the sound input from the first seat audio source 2 to which the transfer characteristic $\hat{S}(z)$ has been input and outputs the same to the first adaptive algorithm execution unit 32.

The first variable filter 31, the first adaptive algorithm execution unit 32, and the estimation filter 33 form a Filtered-X adaptive filter. Using the signal in which the transfer function SA(z) is convolved by the estimation filter 33 and the signal Eu output from the second subtractor 38, the first adaptive algorithm execution unit 32 executes an adaptive algorithm such as NLMS or LMS with the signal output from the second subtractor 38 as an error, and performs an adaptive operation of updating a transfer function W(z) of the first variable filter 31 so that the level of the signal Eu output from the second subtractor 38 becomes minimum. By this adaptive operation, the transfer function W(z) of the first variable filter 31 is updated so that the component of the sound output from the second seat audio source 1 included in the signal Eu is minimized. As a result, the first variable filter 31 is adapted to output a cancel sound that cancels the sound output from the second seat audio source 1 at the position of the ear of the user at the first seat.

The second variable filter 36 and the second adaptive algorithm execution unit 37 also form an adaptive filter. Using the sound output from the first seat audio source 2 and the signal Eu output from the second subtractor 38, the second adaptive algorithm execution unit 37 executes an adaptive algorithm such as NLMS or LMS with the signal output from the second subtractor 38 as an error, and performs an adaptive operation of updating a transfer function U(z) of the second variable filter 36 so as to minimize the level of the signal Eu output from the second subtractor 38. By this adaptive operation, the transfer function U(z) of the second variable filter 36 is updated so that the component of the sound output from the first seat audio source 2 included in the signal Eu is minimized.

By such an operation of the active noise control device 3, the component of the sound output from the second seat audio source 1 and the component of the sound output from the first seat audio source 2 included in the signal Eu sent to the ICC processing unit 4 are minimized.

Therefore, when the voice spoken by the user at the first seat is included in the sound collected by the first seat microphone 9, the spoken voice Eu sent from the active noise control device 3 to the ICC processing unit 4 represents the spoken voice of the user at the first seat.

Figure 4:
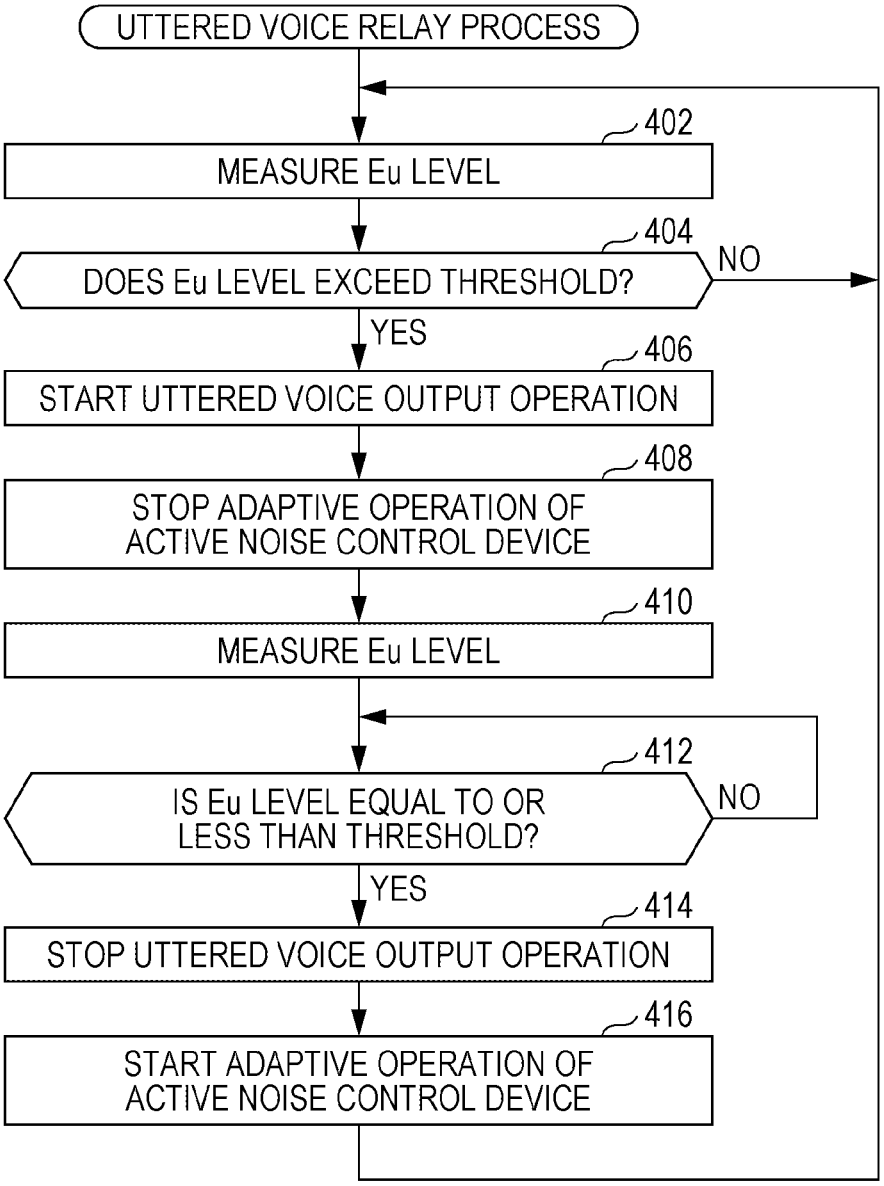
FIG. 4 is a flowchart illustrating a spoken voice relay process according to the embodiment of the invention.

Next, a spoken voice relay process performed by the ICC processing unit 4 to output the spoken voice Eu of the user at the first seat from the second seat speaker 5 via the second seat speaker adder 7 will be described. FIG. 4 illustrates a procedure of the spoken voice relay process. As illustrated in the drawing, the ICC processing unit 4 repeats the measurement (Step 402) of the level of the spoken voice Eu input from the active noise control device 3 in the spoken voice relay process until the measured level exceeds a predetermined threshold (Step 404).

When the measured level of the spoken voice Eu exceeds the predetermined threshold (Step 404), the spoken voice output operation is started (Step 406). In the spoken voice output operation, the second seat speaker adder 7 outputs spoken voice Eu input from active noise control device 3 to output the spoken voice Eu from the second seat speaker 5. In the spoken voice output operation, the spoken voice Eu input from the active noise control device 3 may be subjected to predetermined acoustic processing, and then output to the second seat speaker adder 7 to be output from the second seat speaker 5.

Then, the adaptive operation of the active noise control device 3 is stopped by stopping the update of the transfer function W(z) of the first variable filter 31 and the update of the transfer function U(z) of the second variable filter 36 (Step 408). More specifically, the update of the transfer function W(z) of the first variable filter 31 and the update of the transfer function U(z) of the second variable filter 36 are stopped by setting the step size for determining the gain of the update of the transfer function W(z) performed by the first adaptive algorithm execution unit 32 and the step size for determining the gain of the update of the transfer function U(z) performed by the second adaptive algorithm execution unit 37 to 0. Next, the measurement (Step 410) of the level of the spoken voice Eu input from the active noise control device 3 is repeated until the measured level is less than or equal to the threshold (Step 412).

When the measured level of the spoken voice Eu is less than or equal to the threshold (Step 412), the spoken voice output operation is stopped (Step 414). Then, the adaptive operation of the active noise control device 3 is restarted (Step 416). More specifically, in Step 414, the step size for determining the gain of the update of the transfer function W(z) performed by the first adaptive algorithm execution unit 32 and the step size for determining the gain of the update of the transfer function U(z) performed by the second adaptive algorithm execution unit 37 are returned to the original values before the adaptive operation is stopped in Step 408.

The spoken voice relay process performed by the ICC processing unit 4 has been described above. According to such a process, it is possible to detect the voice of the user at the first seat with high accuracy, perform the spoken voice output operation of outputting, from the second seat speaker 5, a voice including substantially only a component of the spoken voice during the speaking of the user at the first seat, and support the listening to the spoken voice by the user at the second seat of the spoken voice of the user at the first seat.

In the above spoken voice relay process, the adaptive operation of the active noise control device 3 is stopped during the spoken voice output operation in order to prevent the spoken voice of the user at the first seat from acting as a disturbance and malfunctioning due to the adaptive operation.

Figure 5A:
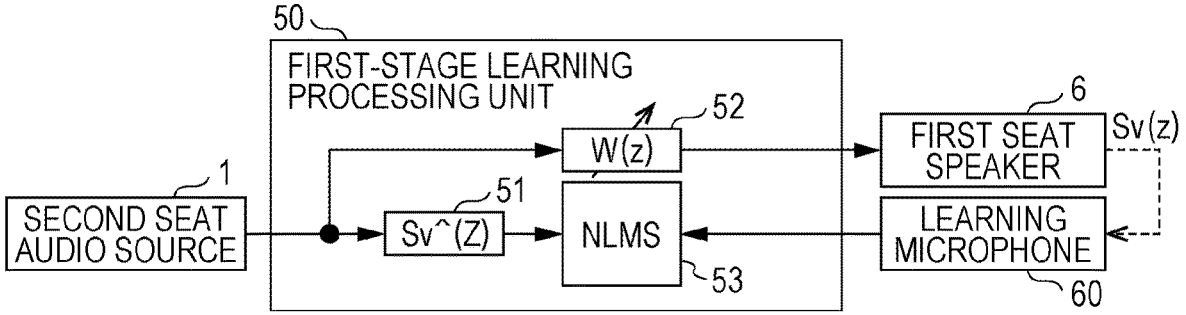
FIGS. 5A and 5B are block diagrams illustrating a configuration of learning of a transfer function of an auxiliary filter according to the embodiment of the invention.

Next, a method for setting the transfer function H(z) of the auxiliary filter 35 of the described-above active noise control device 3 will be described. The transfer function H(z) of the auxiliary filter 35 is set by, for example, performing a first-stage learning process and a second-stage learning process described below in advance while the sound output from the second seat audio source 1 is being output from the second seat speaker 5. The first-stage learning process is performed using a first-stage learning processing unit 50 illustrated in FIG. 5A and a learning microphone 60 disposed at the position of the ear of the first seat user. The first-stage learning processing unit 50 includes a learning estimation filter 51 in which an estimated value Sv^(z) of a transfer function Sv(z) from the first-stage learning processing unit 50 to the learning microphone 60 is set, a first-stage learning variable filter 52, and a first-stage learning adaptive algorithm execution unit 53.

In such a configuration, the sound output from the second seat audio source 1 is input to the first-stage learning variable filter 52, and the output from the first-stage learning variable filter 52 is output to the first seat speaker 6. The sound output from the second seat audio source 1 is input to the first-stage learning adaptive algorithm execution unit 53 through the learning estimation filter 51, and the first-stage learning adaptive algorithm execution unit 53 executes an adaptive algorithm such as NLMS or LMS using the output of the learning estimation filter 51 with the output of the learning microphone 60 as an error, and updates the transfer function W(z) of the first-stage learning variable filter 52.

Figure 5B:
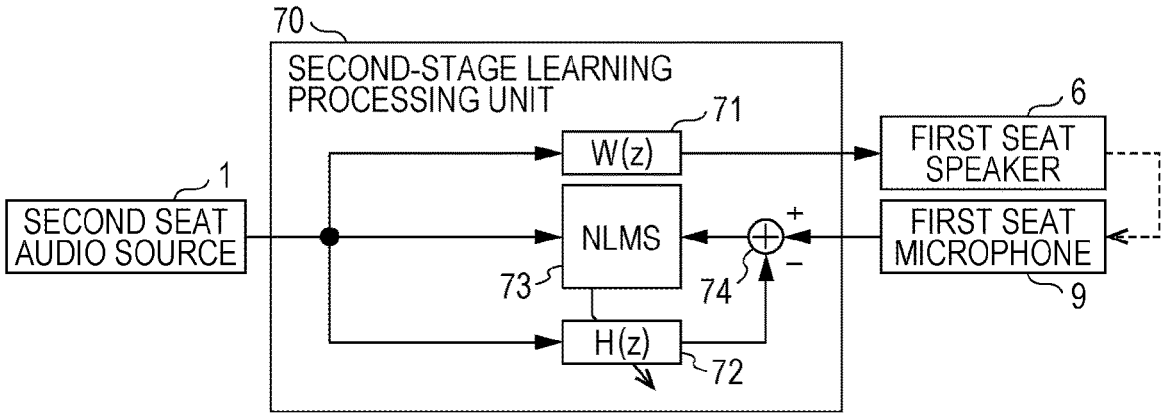

Then, the adaptive algorithm is executed to obtain the transfer function W(z) of the stable convergence first-stage learning variable filter 52 as a result of the first-stage learning process. Next, the second-stage learning process is performed using a second-stage learning processing unit 70 illustrated in FIG. 5B. The second-stage learning processing unit 70 includes a fixed filter 71 to which the transfer function W(z) obtained as a result of the first-stage learning process as a transfer function, a second-stage learning variable filter 72, a second-stage learning adaptive algorithm execution unit 73, and a second-stage learning subtractor 74.

In such a configuration, the sound output from the second seat audio source 1 is output to the first seat speaker 6 through the fixed filter 71. The sound output from the second seat audio source 1 is transmitted to the second-stage learning subtractor 74 through the second-stage learning variable filter 72, and the second-stage learning subtractor 74 subtracts the output of the second-stage learning variable filter 72 from the signal picked up by the first seat microphone 9 and outputs the subtracted signal.

The second-stage learning adaptive algorithm execution unit 73 executes an adaptive algorithm such as NLMS or LMS using the sound output from the second seat audio source 1 with the output of the second-stage learning subtractor 74 as an error, and updates the transfer function H(z) of the second-stage learning variable filter 72.

The adaptive algorithm is executed to set the converged and stabilized transfer function H(z) as the transfer function H(z) for the auxiliary filter 35 of the active noise control device 3. Here, as described above, the transfer function H(z) learned in this manner is a transfer function in which it can be expected in the active noise control device 3 that the output of the first subtractor 34 becomes a signal output from the first seat microphone 9 when the first seat microphone 9 is located at the position of the ear of the user at the first seat.

As described above, according to this embodiment, it is possible to output the spoken voice of the user at the first seat from the second seat speaker 5 with a good SN ratio to the user at the second seat while suppressing the user at the first seat from hearing the sound of the second seat audio source 1 listened to by the user at the second seat.

Although the first seat speaker 6, the second seat speaker 5, and the first seat microphone 9 are provided as single components in the above description, a plurality of first seat speakers 6, second seat speakers 5, and first seat microphones 9 may be provided. When a plurality of first seat microphones 9 are provided, the spoken voice Eu is generated for each of the first seat microphones. In Step 404 of the spoken voice relay process of FIG. 4, the process proceeds to Step 406 to start the spoken voice output operation when all the spoken voice Eu generated for each of the first seat microphones 9 exceeds the threshold.

Although the case where the spoken voice of the user at the first seat is output to the second seat speaker 5 while canceling the sound of the second seat audio source 1 to the user at the first seat has been described above, this embodiment can be similarly applied to a case where the spoken voice of the user at each seat is output to the speaker at the passenger's seat while canceling the sound of the audio source at the passenger's seat to the user at each seat for a plurality of seats.

Further, this embodiment can be applied to a case where the audio source of each seat has a plurality of channels, or can be extended to cancel the sound of the audio source of the passenger's seat for each of the left and right ears of the user.

In addition, the auxiliary filter 35 of the active noise control device 3 of this embodiment may be omitted, and in this case, a similar effect can be obtained to a predetermined extent. In this case, a signal obtained by subtracting the output of second variable filter 36 from the sound collected by first seat microphone 9 is used as signal Eu.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An in-vehicle communication support system mounted in an automobile having a first seat and a second seat which are different seats from each other, the in-vehicle communication support system comprising:

a microphone configured to collect sound of the first seat;

a first sound source device;

a first speaker that is a speaker for a user at the first seat and outputs an output sound of the first sound source device;

a second sound source device;

a second speaker that is a speaker for a user at a second seat and outputs an output sound of the second sound source device;

a noise control unit configured to output, from the first speaker, a cancel sound for canceling the output sound of the second sound source device output from the second speaker to the user at the first seat; and a spoken voice output unit, wherein the noise control unit includes:

a first adaptive filter that receives an output sound of the second sound source device as an input and generates the cancel sound;

a second adaptive filter that receives an output sound of the first sound source device as an input; and a first signal generation unit that generates a first signal which is a signal obtained by subtracting at least an output of the second adaptive filter from an output of the microphone, the first adaptive filter and the second adaptive filter perform an adaptive operation of updating its own transfer function such that a level of the first signal decreases, and the spoken voice output unit outputs the first signal from the second speaker as spoken voice of the user at the first seat, wherein the noise control unit further includes an auxiliary filter that receives an output sound of the second sound source device, the first signal generation unit generates, as the first signal, a signal obtained by subtracting the output of the second adaptive filter and an output of the auxiliary filter from the output of the microphone, and a transfer function obtained in advance as a transfer function for correcting the output of the microphone to a sound collected at a listening position of the sound of the user at the first seat by subtracting the output of the auxiliary filter from the output of the microphone is set to the auxiliary filter.

2. The in-vehicle communication support system according to claim 1, wherein the spoken voice output unit outputs the first signal from the second speaker when the first signal is greater than a predetermined level.

3. The in-vehicle communication support system according to claim 2, wherein the spoken voice output unit stops the adaptive operations of the first adaptive filter and the second adaptive filter when the first signal is larger than a predetermined level.

4. The in-vehicle communication support system according to claim 1, wherein the spoken voice output unit outputs the first signal from the second speaker when the first signal is greater than a predetermined level.

5. The in-vehicle communication support system according to claim 4, wherein the spoken voice output unit stops the adaptive operations of the first adaptive filter and the second adaptive filter when the first signal is larger than a predetermined level.

* * * * *